US007156789B2

(12) United States Patent
Nativ

(10) Patent No.: US 7,156,789 B2
(45) Date of Patent: Jan. 2, 2007

(54) MOBILITY ASSIST

(76) Inventor: Avinoam Nativ, 3428 Baskins Beach Rd. R. R. # 1, Dunrobin, Ontario (CA) K0A 1T0

( * ) Notice: Subject to any disclaimer, the term of this patent is extended or adjusted under 35 U.S.C. 154(b) by 0 days.

(21) Appl. No.: 10/859,182

(22) Filed: Jun. 3, 2004

(65) Prior Publication Data

US 2005/0277528 A1 Dec. 15, 2005

(30) Foreign Application Priority Data

May 28, 2004 (CA) ..... 2469102

(51) Int. Cl.
*A63B 26/00* (2006.01)

(52) U.S. Cl. ..... 482/142; 482/904

(58) Field of Classification Search ..... 482/77, 482/148, 121–130, 144–145, 904; D21/686, D21/672, 412, 688
See application file for complete search history.

(56) References Cited

U.S. PATENT DOCUMENTS

| | | | | | |
|---|---|---|---|---|---|
| 1,380,893 | A * | 6/1921 | Gebert | 280/222 |
| 1,640,150 | A * | 8/1927 | Henry et al. | 472/110 |
| 2,327,671 | A * | 8/1943 | Rupprecht | 280/87.021 |
| D154,323 | S * | 6/1949 | Reed | D21/412 |
| 2,704,111 | A * | 3/1955 | Wunderlich | 297/274 |
| D220,115 | S * | 3/1971 | Semler | D21/412 |
| 3,570,479 | A * | 3/1971 | Horn | 482/145 |
| 3,656,728 | A * | 4/1972 | Griggs | 248/585 |
| 3,806,117 | A * | 4/1974 | Foster | 472/119 |
| 4,188,966 | A | 2/1980 | Palmer et al. | |
| 4,211,426 | A * | 7/1980 | Motloch | 280/87.041 |
| 4,480,846 | A * | 11/1984 | Sanchez | 280/87.041 |
| 5,370,594 | A * | 12/1994 | Grinblat | 482/72 |
| 5,403,239 | A * | 4/1995 | Zimmers | 472/106 |
| 5,547,425 | A * | 8/1996 | Krhs et al. | 472/110 |
| 5,722,917 | A * | 3/1998 | Olschansky et al. | 482/72 |
| 6,168,549 | B1 * | 1/2001 | Squibb et al. | 482/34 |
| 6,247,717 | B1 * | 6/2001 | Lovins et al. | 280/250.1 |
| 6,254,517 | B1 * | 7/2001 | Kennedy | 482/121 |
| 6,428,450 | B1 * | 8/2002 | Ho et al. | 482/140 |
| 6,578,594 | B1 | 6/2003 | Bowen et al. | |
| 2004/0178025 | A1 * | 9/2004 | Zweideck | 188/2 F |

OTHER PUBLICATIONS

Martha Visintin et al., A New Approach to Retrain Gait in Stroke Patients through Body Weight Support and Treadmill Stimulation, Stroke, Jun. 1998, pp. 1122-1128.

* cited by examiner

*Primary Examiner*—Lori Amerson
(74) *Attorney, Agent, or Firm*—David J. French

(57) ABSTRACT

A mobile apparatus for assisting a person with limited mobility. The apparatus is also for developing a higher level of mobility in a person having low mobility. The person may be assisted by the apparatus when walking. The apparatus includes a seating surface resiliently mounted to provide partial body weight support to the person. A person using the mobility assist may grasp lateral handles disposed on the apparatus while walking or he/she may attempt to mobilize without the use of the lateral handles. Multiple elastic cords positioned to generate a lifting force that varies according to the number of elastic cords employed provide the degree of resilience in the seat. The degree of resilience may be adjusted in accordance with the relative collapse of the lower extremities of the person. As the walking ability of the person progresses, such lifting force may be reduced over-time by reducing the number of elastic cords employed.

15 Claims, 5 Drawing Sheets

MOBILITY ASSIST

FIELD OF THE INVENTION

This invention relates to the field of appliances for aiding mobility-impaired individuals to walk about and particularly relates to wheeled walking aids for such individuals.

BACKGROUND TO THE INVENTION

Our present understanding of motor relearning and skill acquisition makes it very clear that an active stage of intensive and speed sensitive training is essential for the development of new movements. The field of rehabilitation is not different in that respect but, unfortunately, in many cases, the requirement for practice cannot be practically fulfilled because of the nature of the impairment, as well as, the tools required to enable such movement. For example, a person with paresis of the lower extremities may not be able to practice tasks needed to improve his/her impaired dynamic stability. Such tasks may include walking, jumping, side stepping, kicking a ball etc. Even with one or two people supporting that individual, the desired freedom of movement may not be achieved.

The gradual build-up, reshaping and refinement of motor skills are part of the process of acquiring skills. Skill-acquisition processes have been extensively studied in an effort to better understand what may facilitate the normal acquisition of skills and the acquisition of skills in the context of a rehabilitation programs. Intensive practice gradually leads to the automation of the learned skill and finally to successful incorporation of that skill into daily activities or sports activities—a process that should no longer be attention demanding.

In order to show progress in the development of the movement/action, the subject should practice efficiently and sufficiently. However, there is the problem of how to provide efficient and sufficient training of mobility and dynamic stability to someone who cannot safely stand on his/her own. What is needed is an apparatus that supports such movement in a safe manner; a mobility-assisting device whose main function is not just assisting the movement but also, primarily—enabling safe and speed sensitive training of the movement.

There are many walkers in the market that support the individual and thus make the task of walking easier. There are few devices and mechanisms that enable higher-level training in a safe environment. One such mechanism that provides Body Weight Support is disclosed in the article: *A New Approach to Retrain Gait in Stroke Patients Through Body Weight Support and Treadmill Stimulation*; Martha Visintin, Hugues Barbeau, Nicol Korner-Bitensky, and Nancy E. Mayo; Stroke, June 1998; 29: Pp. 1122–1128. This mechanism is typically very expensive, restricted to a treadmill and provides support from above—through a harness mechanism. It would be better to have a mechanism that allows more variability in training and supports the individual from underneath, thus allowing for freedom of movement in the trunk and lower extremities.

U.S. Pat. No. 6,578,594, issued Jun. 17, 2003, the contents of which are incorporated herein by reference, describes a mobile rehabilitative walker that may be moved by a user to allow for training of gait and dynamic stability. However, this device is not a body weight support mechanism in the sense that has a safety harness suspended from above. The harness is for preventing falls but is not designed to reduce the person weight while he/she moves. Furthermore, the harness is restrictive for forward and sideward movements, being framed at the front and sides, and does not provide an optimum enabling environment. U.S. Pat. No. 2,327,671, issued Aug. 24, 1943, the contents of which are incorporated herein by reference, seems to provide a better training environment than U.S. Pat. No. 6,578,594 in that it provides body weight support and free anterior space to mobilize i.e., the training person here would be able to take steps forward without the restriction of a frame and, also, engage in ball games that could further improve stability. However, U.S. Pat. No. 2,327,671 seems to lack a pelvis support mechanism that would allow for normal standing posture since a person without sufficient leg strength would be typically seated rather than standing with the type of standing harness described in U.S. Pat. No. 2,327,671. Furthermore, the base of the walker apparatus appears narrow and does not allow for free lateral movement.

U.S. Pat. No. 4,211,426, issued Jul. 8, 1980, the contents of which are incorporated herein by reference, describes a "weight relieving ambulator". The type of support mechanism used in that invention—strapping around the trunk—would not allow for use by people with very weak lower extremities since their legs would be very likely to collapse. As well, the range of vertical movement of the harness is limited due to the structural construction of the "ambulator". Furthermore, the base of the "ambulator" appears to limit lateral movement of the person.

An invention that supports walking is described in U.S. Pat. No. 4,188,966, issued Feb. 19, 1980, the contents of which are incorporated herein by reference. However, it appears to lack an adjustable pelvic support and, again, does not allow for free lateral movement of the person using it. In this particular invention, the trunk of the person is restricted in mobility.

What is needed in the mobility enhancement and rehabilitation field is a mobility assist that provides variable body weight support but also allows for maximum mobility of the trunk and extremities. Such device would also have an option of opening its base wide to allow for effective lateral mobility of the user.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims that conclude this Specification.

SUMMARY OF THE INVENTION

According to one aspect of the invention, a mobility assist is provided comprising a mobile structure, a rocking frame pivotally coupled to the mobile structure and resiliently coupled to the mobile structure, and a seat coupled to the rocking frame, the seat for supporting at least a portion of a weight of a person endeavoring to walk, the mobility assist thereby assisting the person in walking.

According to a further feature of the invention, the mobility assist further comprises handles disposed on either side of the seat for grasping by the person endeavoring to walk.

By a further feature of the invention, the rocking frame includes a first end and the mobility assist further comprises a seat axle, the seat axle for being attached to the seat; and a pivot linkage, said pivot linkage having a first linkage end for being coupled to the first end of the rocking frame and a second linkage end for being coupled to the seat axle whereby, the seat is pivotally coupled to the rocking frame.

By yet another feature of the invention, the rocking frame includes a second end and the mobility assist further comprises resilient means for resiliently coupling the second end of the rocking frame to the mobile structure.

By an additional feature of the invention, resilient means comprises a plurality of elastic cords each having first and second ends and further having coupling means disposed at each of the first and second ends, the coupling means for coupling the first end to the rocking frame and the second end to the mobile structure.

By a further additional feature of the invention, a number of elastic cords is variable whereby the resilience of the coupling of the second end of the second end of the rocking frame to the mobile structure is in dependence on the number of elastic cords.

By yet another additional feature of the invention, the mobile structure is mounted on roller support means to provide mobility to the mobile structure.

By another feature of the invention, the mobility assist further comprises articulated legs each including two members, one of the members including a roller support means.

By another feature of the invention, each of the articulated legs includes a substantially vertical axis about which one of the two articulated leg members is for being pivoted.

By yet another feature of the invention, at least one of the two articulated leg members is mounted for being pivoted away from the person endeavoring to walk.

By yet another feature of the invention, the mobility assist comprises a locking means for locking the two articulated leg members in a fixed relative position.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Throughout this specification, reference to "walking" or "endeavoring to walk" shall be construed as a reference to any activity requiring an individual to be in a substantially upright position. Such activities include, but are not restricted to, walking, jumping, side stepping, kicking a ball etc.

Figure 1:
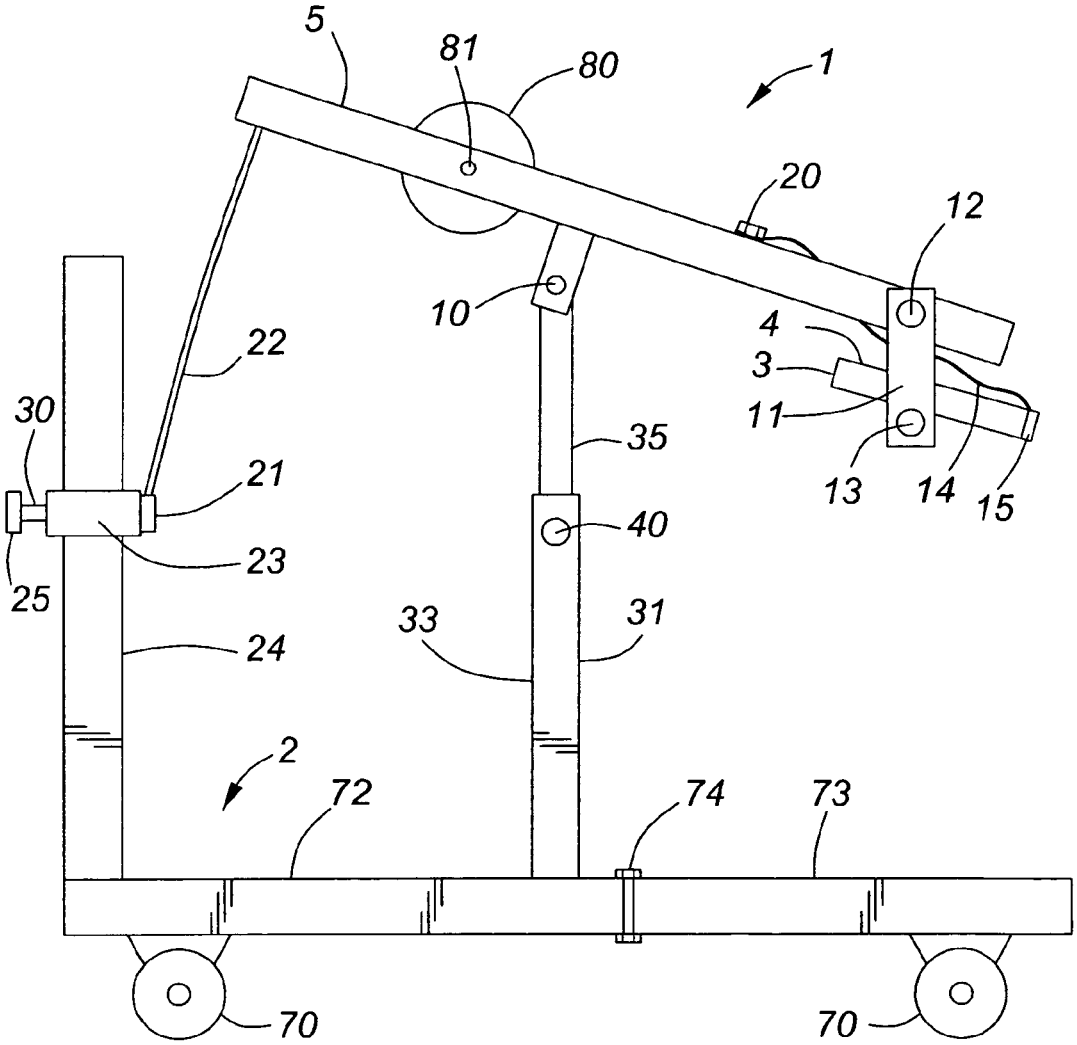
FIG. 1 is a side view of a pictorial depiction of a mobility assist according to a preferred embodiment of the invention.
Figure 2:
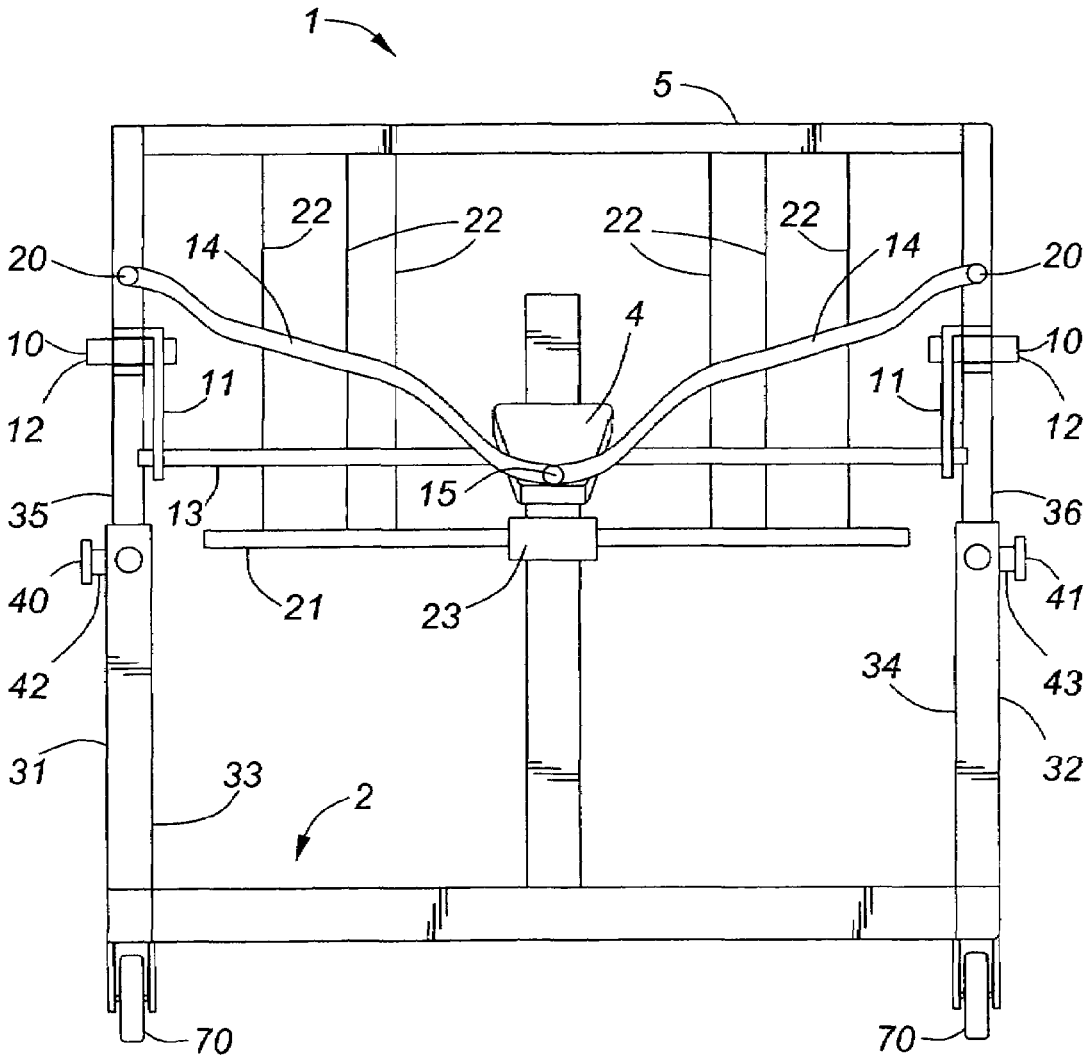
FIG. 2 is a front view of a pictorial depiction of a mobility assist device according to a preferred embodiment of the invention.

FIGS. 1 and 2 depict a mobility assist 1 having a mobile structure 2 provided with a seat 3 having a seat-support surface 4. The seat 3 is resiliently supported within the mobile structure 2 by a rocking frame 5 pivotally mounted to the mobile structure 2 through pins 10. The rocking frame 5 carries the seat 3 through linkages 11 pivotally coupled at one end to the rocking frame 5 through pins 12 and at the other end to seat 3 through a seat axle 13 about which seat 3 may pivot. The seat 3 may include a belt 14 releasably attached to the seat through an attachment 15 and to the rocking frame 5 through attachments 20. The seat 3 is oriented so that, when using the device, the person being assisted in walking positions himself or herself on or above the seat-support surface 4, facing away from the centre of the support structure 2. The belt 14 helps to ensure that the person does not "slip" and fall forward, away from the support structure, and the tilt and degree of taper in the seat help to prevent the user from falling backwards, towards the support structure 2. The other end of rocking frame 5 is resiliently coupled to a vertically adjustable horizontal member 21 by resilient means 22 in the form of a plurality of rubber straps, or bungee cords or springs or combinations thereof. The resilient means 22 provide resilience for rocking frame 5 and seat 3.

Figure 3:
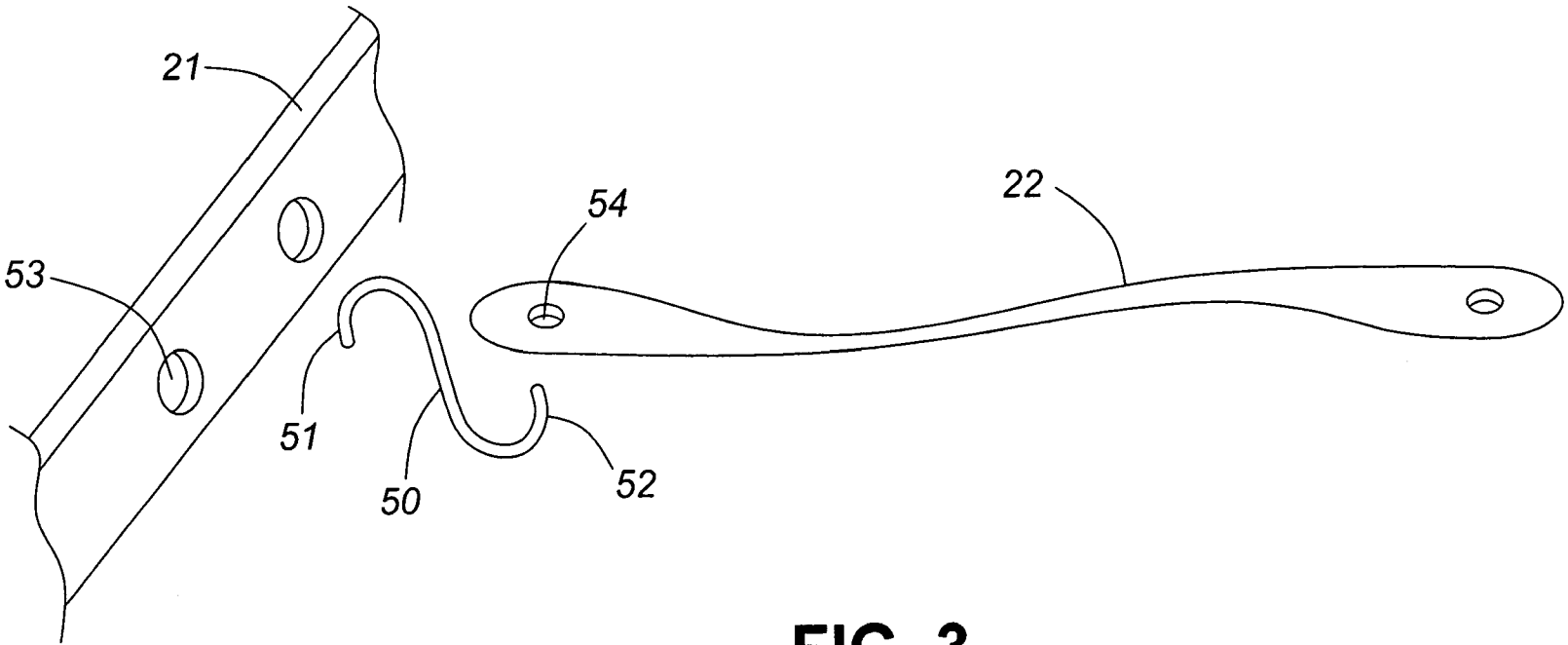
FIG. 3 depicts an elastic means with a coupling.

The number of resilient means 22 may be varied to provide variable resilience. A manner in which resilient means 22 may be coupled to the vertically adjustable horizontal member 21 and the rocking frame 5 is by a hook and hole means depicted in FIG. 3. There, a hook 50 having two curved ends 51 and 52 for inserting into holes 53 and 54 respectively, couples resilient means 22, shown here as a rubber strap, to vertically adjustable horizontal member 21. The other end of resilient means 22 of FIG. 3 may be coupled to the rocking frame 5 in a similar manner.

The adjustable horizontal member 21 is attached to collar 23 that slideably fits over vertical member 24. A pin and hole adjusting means is provided on collar 23 and vertical member 24 to adjust the height of adjustable horizontal member 21. Knob 25 is shown at the end of pin 30. The pin 30 may be spring mounted in collar 23. Holes for receiving pin 30 in vertical member 24 are not depicted.

The height of rocking frame 5 may be adjusted by adjusting the lengths of telescopic vertical members 31 and 32. A pin and hole adjusting means may also be provided on lower telescopic vertical member components 33 and 34 and upper telescopic vertical member components 35 and 36, the former, 33 and 34, having spring loaded pins 42 sand 43 and the latter, 35 and 36, having the holes. In FIGS. 1 and 2, knobs 40 and 41 are disposed at the end of pins 42 and 43.

Thus, a person using the mobility assist would be able to adjust, or to have adjusted, the height of the rocking frame 5 through telescopic vertical members 31 and 32, and adjust the resilience of the rocking frame 5 and seat 3 by varying the number of resilient means 22 used in coupling the rocking frame 5 and the adjustable horizontal member 21.

A cushioning means 80 is shown in FIG. 1. Cushioning means 80 may be mounted on an axle 81 extending from one side of rocking frame 5 to the other. Cushioning means 80 is for softening the impact suffered by a person falling backwards while using mobility assist 1. For sake of clarity, cushioning means 80 is not depicted in the other figures.

Figure 4:
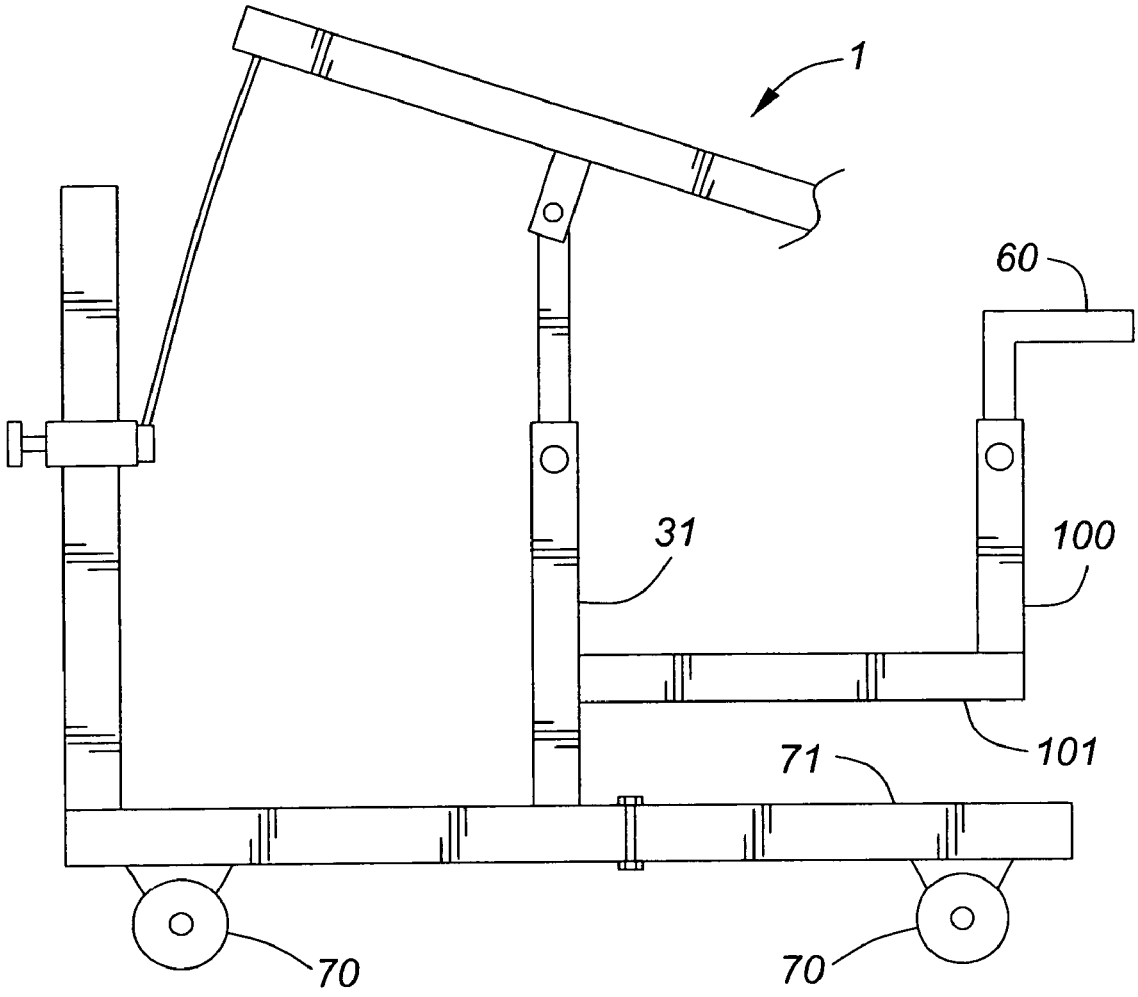
FIG. 4 is a partial side view depicting a mobility assist device with handles.
Figure 5:
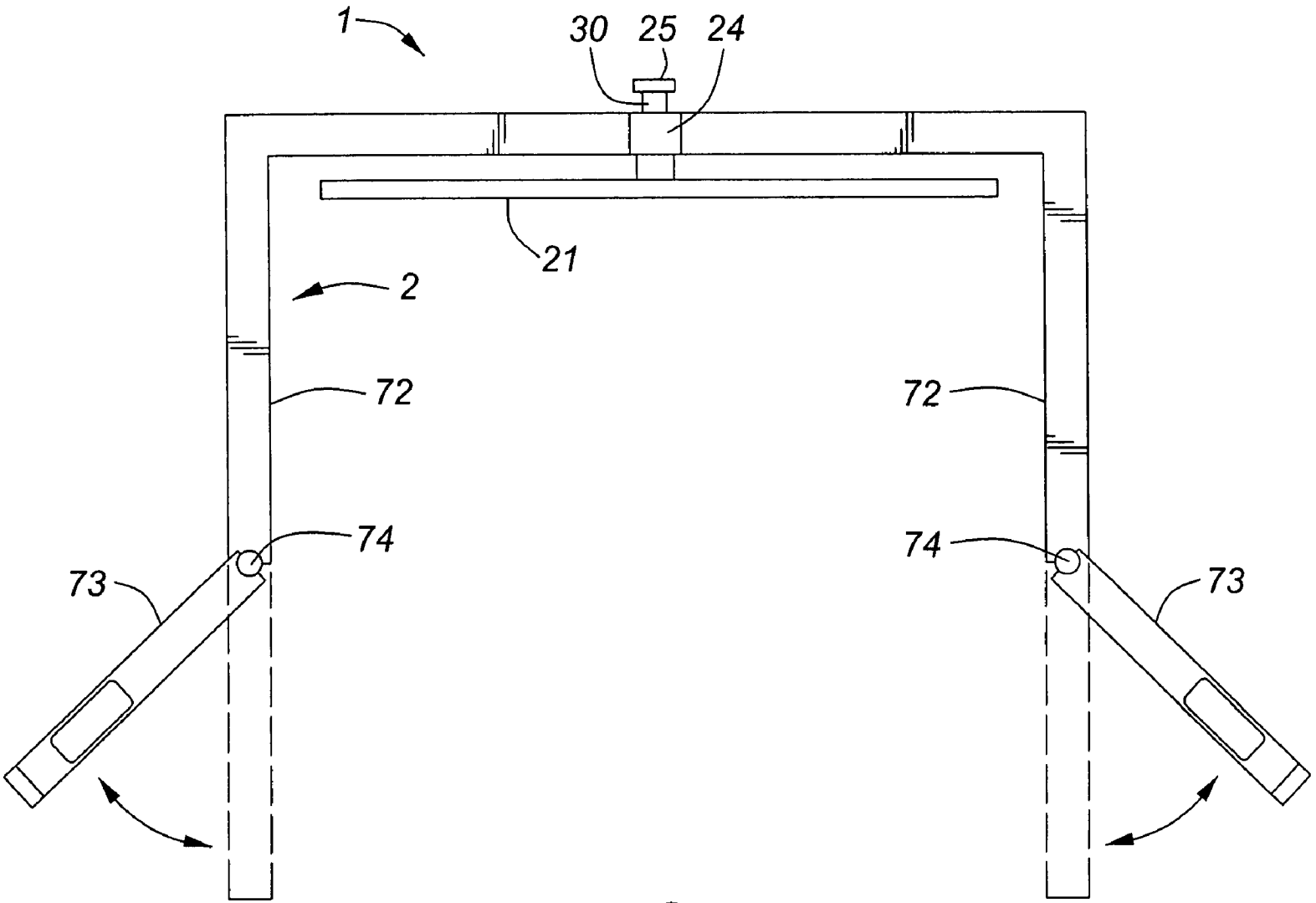
FIG. 5 is a partial top view depicting the articulated legs of the mobility assist.

As shown in FIG. 4, where, for sake of clarity, the portion of the drawing showing the seat 3 and its surroundings has been omitted, the mobility assist 1 may be provided with a pair of handles 60 disposed laterally on either side of the seat 3. The handles 60 are for grasping by a person while engaged in a mobility assist 1 activity. The person is then supported by the seat-support surface 4 while grasping handles 60. The height of the handles may be adjustable in a manner similar to the manner described for the adjustability of the height of the rocking frame 5. The handles 60 may be coupled to telescopic vertical member 31 through vertical member 100 and horizontal member 101 as shown in FIG. 4. It will be understood by someone skilled in the art of rehabilitation that handles 60 are not necessary for a person having sufficient strength and mobility.

As the seat 3 is resiliently mounted in mobility assist 1 and is allowed to move vertically with a person's centre of gravity, the person is encouraged to use his/her legs to rise slightly more up-right. The person may then practice the exercise of walking, with a portion of his/her body weight carried by the seat-support surface 4. As the walking ability of the person improves, his/her centre of gravity will rise, thus reducing the amount of body weight supported by mobility assist 1. Furthermore, resilient means 22 may be removed, thereby reducing the degree of support provided (i.e. the resilience of the seat 3 is in dependence on the number of resilient means 22). In this manner, the rehabilitation process is able to advance more rapidly.

The mobile structure 2 is shown in FIGS. 1, 2 and 4 as being mounted on low-friction roller support means shown as castor wheels 70 which permit the frame to be easily moved across a floor. A partial top view of mobility assist 1 is shown in FIG. 4. There, the rocking frame 5, handles 60 and telescopic vertical member 31 are not depicted. The mobile structure 2 as depicted may comprise articulated members that carry castor wheels 70. Each articulated member is preferably in the form of a pair of horizontal members 73 mounted to frame members 72 with at least one of horizontal members 73 being laterally extendable outwardly of seat 3. Each of such horizontal members are preferably rotatable at one end about a vertical axis 74 that will allow such horizontal members to be swung outwardly, away from the position of a user resting on the seat-support surface 4.

By swinging such horizontal members 73 outwardly, greater lateral stability is provided to the mobility assist 1. Furthermore, having horizontal members 73 outwardly extended allows a person using the mobility assist to participate better in games requiring foot skills such as soccer. Locking means (not shown) may be provided in association with horizontal members 73 to maintain their relative orientation at preferred angles.

The foregoing has constituted a description of specific embodiments showing how the invention may be applied and put into use. These embodiments are only exemplary. The invention in its broadest, and more specific aspects is further described and defined in the claims that now follow.

These claims, and the language used therein, are to be understood in terms of the variants of the invention that have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A mobility assist device comprising:

(a) a seat for supporting at least a portion of the weight of a person endeavoring to walk, said seat being located at a height above the ground whereby such person may remain in continuous contact with the ground;

(b) a mobile support structure;

(c) a rocker beam having a first end and a second end, said rocker beam being carried by a rocking beam pivot at a point intermediate said first end and said second end, said first end of said rocker beam being resiliently coupled to said mobile support structure through a resilient coupling member; and (d) said second end of said rocker beam carrying said seat;

whereby said person endeavoring to walk may be assisted in walking by resting at least a portion of the weight of said person upon said seat while the seat is oriented such that said person endeavoring to walk faces away from the support structure and wherein the seat is oriented to provide that the legs of said person endeavoring to walk are substantially free in the user's forward direction from obstructions associated with the mobile support structure.

2. The mobility assist device as claimed in claim 1, further comprising:

(e) at least one handle carried by the mobile support structure and positioned for grasping by said person endeavoring to walk.

3. The mobility assist device as claimed in claim 2, further comprising:

(f) a seat axle positioned between said seat and said second end of said beam for pivotally supporting said seat.

4. The mobility assist device as claimed in claim 1, wherein said resilient coupling member comprises elastic cord means having a first cord end and a second cord end, and further having cord connection means disposed at each of said first cord end and said second cord end, said cord connections means being positioned for coupling said first cord end to said rocker beam and said second cord end to said mobile structure.

5. The mobility assist device as claimed in claim 4, wherein said elastic cord means comprises a plurality of detachable elastic cords, whereby the resilience of said resilient coupling member may be varied to allow the degree of support provided by the seat to said person endeavoring to walk to be varied in accordance with the number of said detachable elastic cords.

6. The mobility assist device as claimed in claim 1, wherein said mobile structure is mounted on roller supports, thereby to provide mobility to said mobile structure.

7. The mobility assist device as claimed in claim 6, wherein said mobility assist device further comprises a pair of articulated legs, each of said legs being pivotally mounted to said support structure about a substantially-vertical axis, thereby to permit deployment of said legs in a horizontal plane away from said person endeavoring to walk.

8. The mobility assist device as claimed in claim 7, further comprising a lock for locking said articulated legs in a fixed position with respect to said support structure.

9. The mobility assist device as claimed in claim 7 wherein, with the deployment of said legs away from said person endeavoring to walk, the legs of such person have a greater range of freedom in the direction lateral to the forward direction than when such legs are not so deployed.

10. A mobility assist device comprising:

(a) a mobile support structure;

(b) a beam which is pivotally connected at a pivot point to the mobile support structure;

(c) a seat, resiliently supported by the beam, for supporting at least a portion of the weight of a person endeavoring to walk, said seat being located at a height above the ground whereby such person may remain in continuous contact with the ground and being positioned and oriented such that said person endeavoring to walk faces away from the support structure with the legs of said person being substantially free in the person's forward direction from obstructions associated with the mobile support structure whereby said person will be assisted in walking by resting at least a portion of the weight of said person upon said seat.

11. The mobility assist device as claimed in claim 10, comprising resilient means extending between the support structure and the beam to apply an upwardly-directed resilient force to the beam.

12. The mobility assist device as claimed in claim 10, wherein said mobile structure is mounted on roller supports, thereby to provide mobility to said mobile structure.

13. The mobility assist device as claimed in claim 10, wherein said mobility assist device further comprises a pair of articulated legs, each of said legs being pivotally mounted to said support structure about a substantially-vertical axis, thereby to permit deployment of said legs in a horizontal plane away from said person endeavoring to walk.

14. The mobility assist device as claimed in claim 13, further comprising a lock for locking said articulated legs in a fixed position with respect to said support structure.

15. The mobility assist device as claimed in claim 13 wherein, with the deployment of said legs away from said person endeavoring to walk, the legs of such person have a greater range of freedom in the direction lateral to the forward direction than when such legs are not so deployed.

* * * * *